US005617821A

United States Patent [19]

Tsunoda et al.

[11] Patent Number: 5,617,821

[45] Date of Patent: Apr. 8, 1997

[54] 4-CYCLE ENGINE

[75] Inventors: Masaki Tsunoda; Shigeaki Kuwabara; Sadafumi Shidara, all of Wako, Japan

[73] Assignee: Honda Giken Kogyo Kabushiki Kaisha, Tokyo, Japan

[21] Appl. No.: 642,961

[22] Filed: May 6, 1996

Related U.S. Application Data

[62] Division of Ser. No. 446,519, May 22, 1995, Pat. No. 5,549,091, which is a division of Ser. No. 127,553, Sep. 28, 1993, Pat. No. 5,438,963.

[30] Foreign Application Priority Data

Sep. 30, 1992 [JP] Japan ..... 4-262583
Sep. 30, 1992 [JP] Japan ..... 4-262587

[51] Int. Cl.[6] ..... F02B 75/22

[52] U.S. Cl. ..... 123/195 P; 123/54.4

[58] Field of Search ..... 123/195 P, 195 HC, 123/54.4, 54.6

[56] References Cited

U.S. PATENT DOCUMENTS 5,353,758 10/1994 Masuda et al. ..... 123/195 HC
5,367,998 11/1994 Shiohara et al. ..... 123/54.4
5,388,555 2/1995 Shiomi et al. ..... 123/195 P
5,438,963 8/1995 Tsunoda et al. ..... 123/54.4
5,476,402 12/1995 Nakai et al. ..... 123/195 P

*Primary Examiner*—David A. Okonsky
*Attorney, Agent, or Firm*—Armstrong, Westerman, Hattori, McLeland & Naughton

[57] ABSTRACT

A four-cycle engine including a magnetic detection sensor mounted on a non-magnetic cam shaft pulley which is rotated in operative association with a crank pulley for detecting a plurality of detecting portions formed on the magnetic detection member by coils mounted in the cylinder head. The magnetic detection member is integrally formed with the plurality of detection portions for different uses such that distances from the center of rotation of the cam shaft pulley to the plurality of detection portions are different, and wherein the coils are separately mounted in correspondence to the detection portions. Thus, it is possible not only to take out timing signals for different uses from a single cam shaft pulley, but also to eliminate interference between the discrete coils.

1 Claim, 11 Drawing Sheets

4-CYCLE ENGINE

This is a divisional of application Ser. No. 08/446,519 filed May 22, 1995 and now U.S. Pat. No. 5,549,091, which was a divisional of application Ser. No. 08/127,553, filed Sep. 28, 1993 and now U.S. Pat. No. 5,438,963.

BACKGROUND OF THE INVENTION

1. Field of the Invention

The present invention relates to a 4-cycle engine.

2. Description of the Related Art

In recent years, a 4-cycle engine with two cylinder axes disposed in a V-shape has been proposed, which includes an electronically controlled type fuel injection system (for example, see Japanese Utility Model Application Laid-open No. 127779/90). In this engine, a substantially Y-shaped distributing type intake pipe is disposed inside a V-bank, and a single injector is disposed upstream from a junction of the intake pipe, to supply a fuel.

In the above prior art engine, no special consideration is taken into account for reducing the size of an intake device upstream from the injector and thus, there is a problem that an engine becomes large due to such intake device.

In general, a 4-cycle marine engine is used in an environment which promotes rusting more than for an engine for a motorland vehicle and thus, many parts of aluminum alloy and stainless steel are employed. For example, a cam pulley forming a portion of a valve-operating system is made of aluminum alloy. Therefore, in order to take out a spark timing pulse from the rotation of the cam pulley, a metal piece of a magnetic material is secured to an inner peripheral surface of a rim portion of the cam pulley, and a pick-up coil is disposed so that it is opposed to the metal piece.

With the above construction, however, only one piece of magnetic material is attached to one cam pulley. For example, in a 4-cycle engine including an electronically controlled type fuel injection system, it is difficult to take out a timing pulse for injection of a fuel in addition to the above-described spark timing pulse.

SUMMARY OF THE INVENTION

Accordingly, it is a first object of the present invention to reduce a size of the intake device of the 4-cycle engine.

To achieve the above first object, according to the present invention, there is provided a 4-cycle engine comprising a cylinder block having a substantially horizontal cylinder, a cylinder head coupled to the cylinder block, and a combustion chamber formed in the cylinder head, wherein the engine further includes an intake passage formed in the cylinder head to extend from the combustion cheer and opened into an outer wall of the cylinder head, an intake gas introducing means disposed laterally of the cylinder head to communicate with the intake passage, and a throttle body disposed below the intake gas introducing means to communicate with the intake gas introducing means.

With the above construction, the intake gas introducing means and the throttle body are mounted in a vertical superposition as seen in a plan view to reduce the amount of projection sideways of the engine, thereby reducing a size of the engine.

It is a second object of the present invention to properly take out a plurality of types of timing pulses in 4-cycle engine.

To achieve the above mentioned second object, according to the present invention, there is provided a 4-cycle engine comprising a magnetic detection member mounted on a cam pulley of a non-magnetic material which is rotated in operative association with a crank pulley, for detecting a plurality of detection portions formed on the detection magnetic member by coils mounted in a cylinder head, wherein the magnetic detection member is integrally formed with the plurality of detection portions for different uses in such a manner that distances from the center of rotation of the cam pulley to the plurality of detection portions are different, and wherein the coils are separately mounted in correspondence to the detection portions.

With the above mentioned construction, it is possible not only to take out timing signals for different uses from the single cam pulley, but also to eliminate an influence between the discrete coils to prevent a mis-detection.

The above and other objects, features and advantages of the invention will become apparent from the following description of preferred embodiments, taken in conjunction with the accompanying drawings.

BRIEF DESCRIPTION OF THE DRAWINGS

FIGS. 1 to 12 illustrate a first embodiment of the present invention, wherein FIG. 1 is a side view of the entire outboard motor;

FIG. 2 is a sectional view taken along a line 2—2 in FIG. 1;

FIG. 3 is a sectional view taken along a line 3—3 in FIG. 2;

FIG. 4 is a sectional view taken along a line 4—4 in FIG. 3;

FIG. 5 is a sectional view taken along a line 5—5 in FIG. 4;

FIG. 6 is a sectional view taken along a line 6—6 in FIG. 4;

FIG. 7 is a sectional view of a right cam pulley;

FIG. 8 is a view taken along a line 8—8 in FIG. 7;

FIG. 9 is a sectional view of a left cam pulley;

FIG. 10 is a view taken in a direction indicated by an arrow 10 in FIG. 9;

FIG. 11 is a block diagram of a control system; and

FIG. 12 is an enlarged view of an essential portion shown in FIG. 4, illustrating an intake port; and FIGS. 13 and 14 illustrate a second embodiment of the present invention, wherein FIG. 13 is a sectional view of a right cam pulley; and FIG. 14 is a view taken along a line 14—14 in FIG. 13.

DESCRIPTION OF THE PREFERRED EMBODIMENTS

Figure 1:
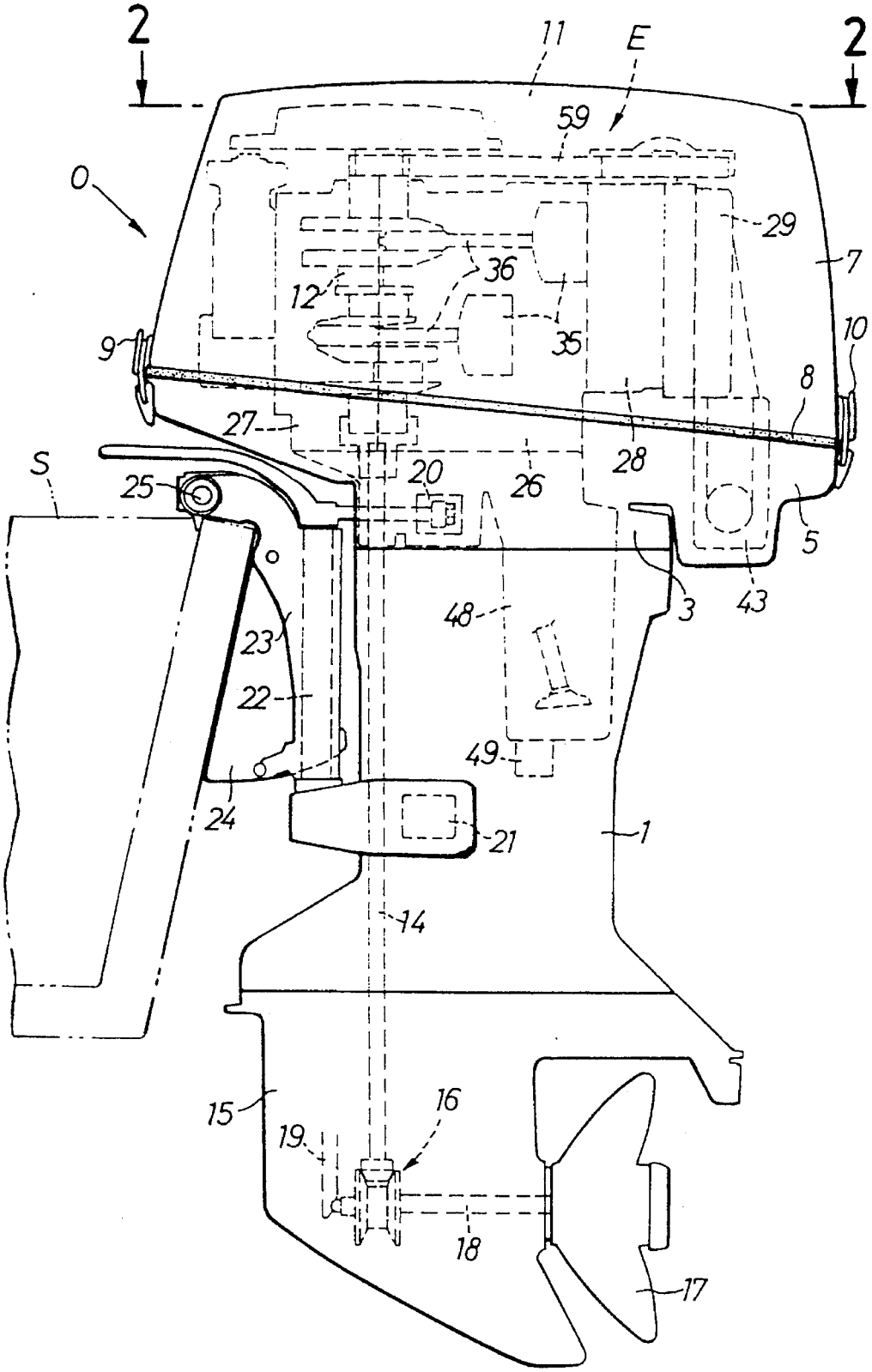

A first embodiment of the present invention will now be described in connection with FIGS. 1 to 12.

Referring to FIGS. 1 to 4, an outboard motor O includes a mounting member 3 coupled to an upper portion of an extension case 1 through a plurality of bolts 2. A V-type 4-cylinder and 4-cycle engine E is supported on an upper surface of the mounting member 3 through a plurality of bolts 4. An undercase 5 with its upper surface opened is coupled to the mounting member 3 through a plurality of bolts 6, and an engine cover 7 is detachably mounted on an upper portion of the undercase 5. The engine cover 7 is coupled to an upper edge of the undercase 5 through a sealing member 8 provided at a lower edge of the engine cover 7 and is fixed by a pair of front and rear clips 9 and 10. The engine E is accommodated within an engine room 11 defined inside the engine cover 7 in such a manner that a crankshaft 12 is disposed in a vertical attitude and a pair of banks $\mathbf{13}_L$ and $\mathbf{13}_R$ are splayed rearwardly.

A driving shaft 14 is connected in series to a lower end of the crankshaft 12 of the engine E, and extends downwardly within the extension case 1. A lower end of the driving shaft 14 is connected to a propeller shaft 18 having a propeller 17 at a rear end thereof, through a bevel gear mechanism 16 provided within a gear case 15. A shifting member 19 is connected at its lower end to a front portion of the bevel gear mechanism 16 for changing-over the direction of rotation of the propeller shaft 18.

A swivel shaft 22 is fixed between an upper mount 20 provided in the mounting member 3 and a lower mount 21 provided in the extension case 1. A swivel case 23 for rotatably supporting the swivel shaft 22 is vertically swingably supported through a tilt shaft 25 on a stern bracket 24 mounted at a rear end of a hull S.

The engine E includes a cylinder block 26 which forms a V-shape as seen in a plan view, a crankcase 27 which cooperates with the cylinder block 26 to define a crank chamber, a pair of cylinder heads 28, 28 coupled to a pair of deck surfaces of the cylinder block 26, and head covers 29, 29 coupled to the cylinder heads 28, 28. The left and right head covers 29, 29 are disposed in proximity to an inner surface of the engine cover 7 and thus, an interior of the engine room 11 is divided into a front space 30 located at a front portion of the engine E and a rear space 31 located at a rear portion of the engine E. Accommodated in the front space 30 are, in addition to a control device 32 for an electronically controlled type fuel injection system and a control device 33 for a spark plug, engine auxiliaries such as a starter motor 93 having a pinion 92 meshed with a gear $\mathbf{91}_1$ formed around an outer periphery of a flywheel 91 provided at an upper end of the crankshaft 12, an oil filter 94, and an oil pump 95 provided at a lower end of the crankshaft 12. A fuel supply system and an intake system are accommodated in the rear space 31.

Figure 5:
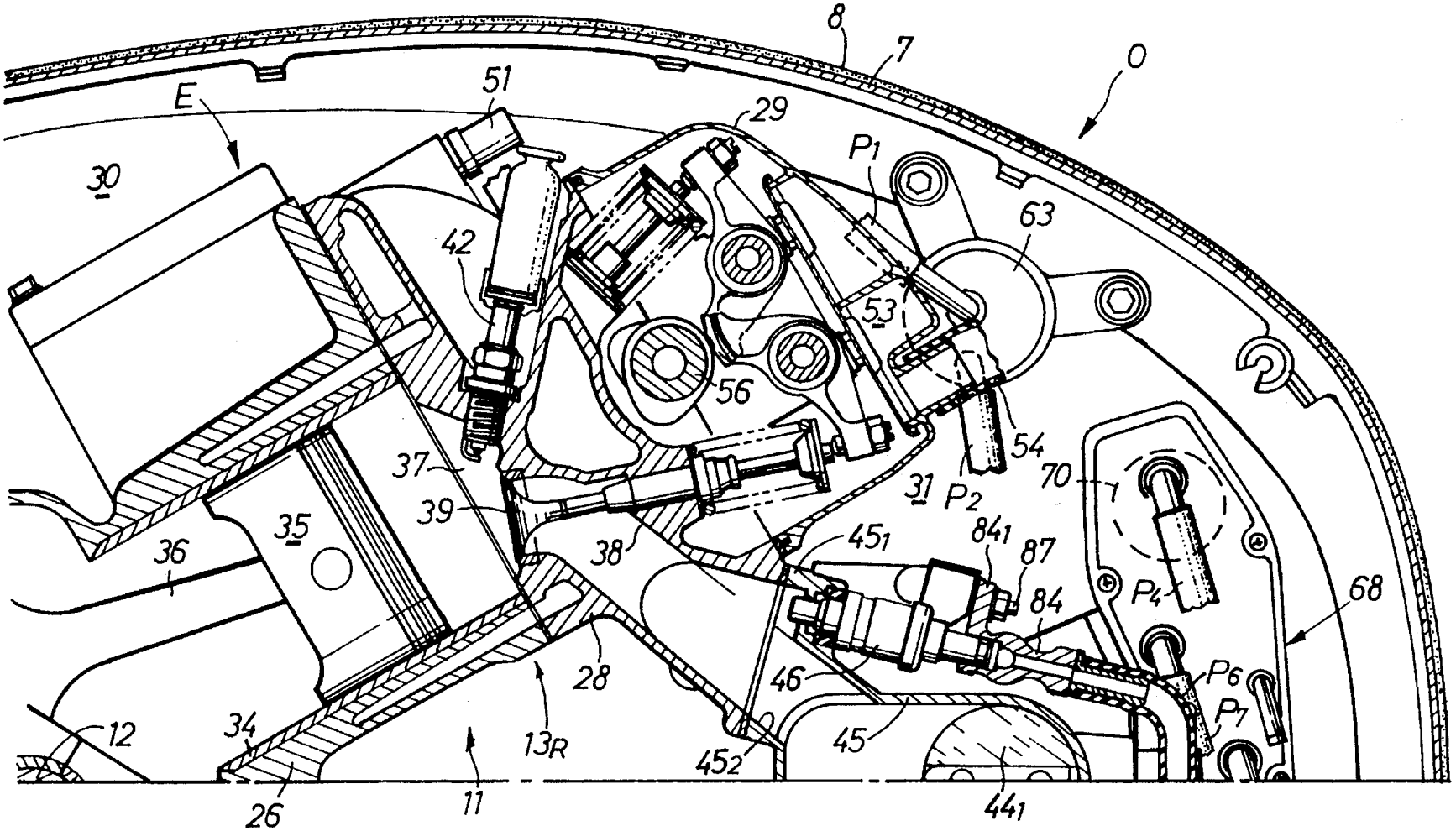
Figure 6:
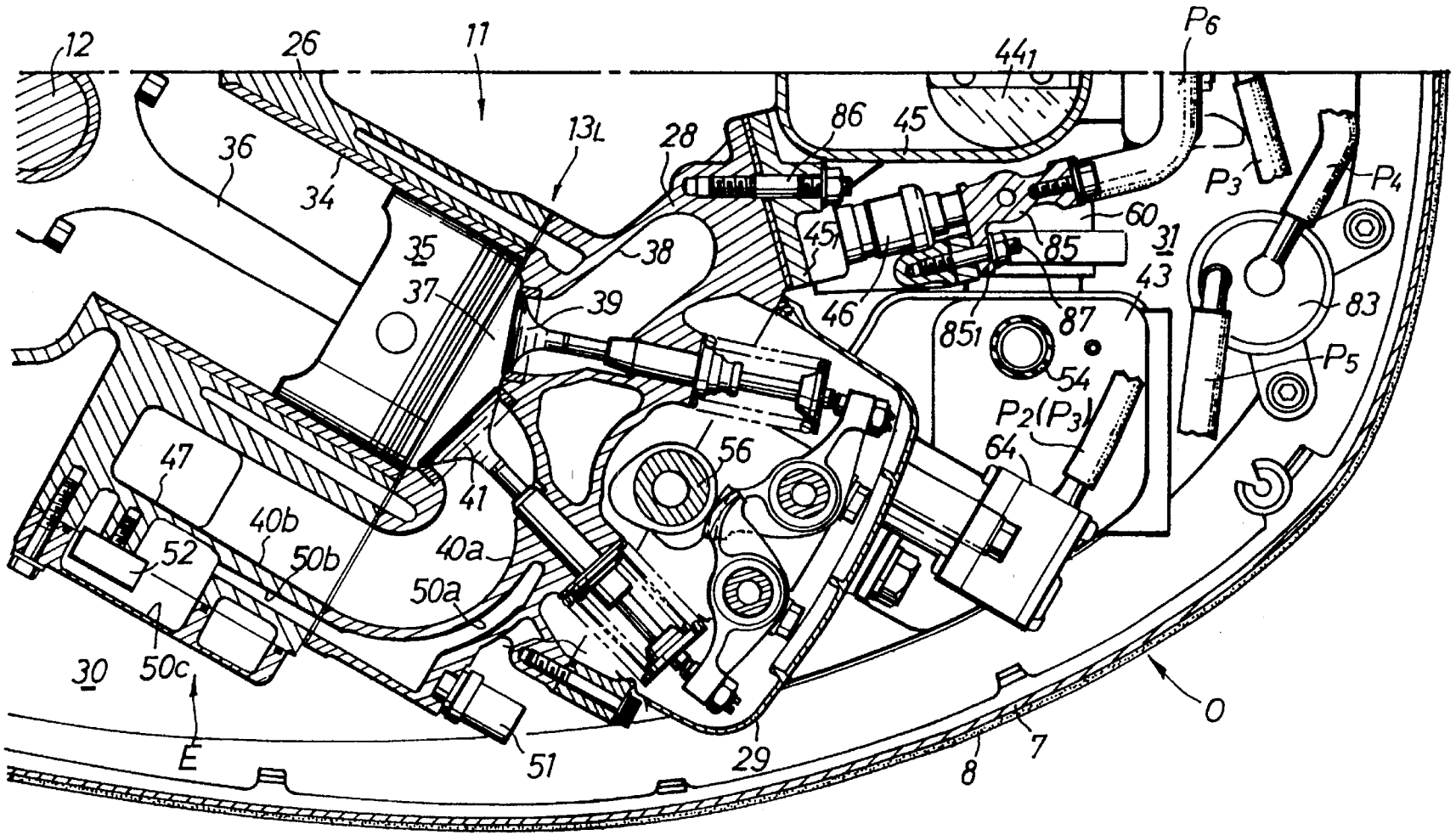

Referring also to FIGS. 5 and 6, each of the banks $\mathbf{13}_L$ and $\mathbf{13}_R$ of the engine E includes two upper and lower cylinders 34 having a horizontal axis. Four pistons 35 each slidably received in corresponding one of the cylinders 34 are connected to the crankshaft 12 through connecting rods 36. Four combustion chambers 37 are defined in correspondence to tops of the cylinders 34, respectively. Each of the four combustion chambers 37 is provided with two intake valves 39, 39 connected to a bifurcated intake port 38 defined in the cylinder head 28; a single exhaust valve 41 connected to an exhaust port $\mathbf{40}_a$ defined in the cylinder head 28 and to an exhaust port $\mathbf{40}_b$ defined in the cylinder block 28; and a single plug 42.

Air is drawn into each of the intake ports 38 through an intake silencer 43, an elbow 60, a throttle body 44 and a surge tank 45 which are disposed in the rear space 31 of the engine room 11, and fuel injected from an injector 46 provided in each of the intake ports 38 is mixed with this air. A pair of exhaust passages 47, 47 formed vertically in the cylinder block 26 are connected to the two exhaust ports **40*a* and 40*b* of each of the left and right banks $\mathbf{13}_L$ and $\mathbf{13}_R$, and are also connected to a pair of exhaust pipes 49, 49 extending downwardly along opposite sides of an oil pan mounted on a lower surface of the mounting member 3. An exhaust gas discharged from the exhaust pipes 49, 49 is passed through insides of the extension case 1 and the gear case 15 and discharged through a boss of the propeller 17** into water.

Water jackets $\mathbf{50}_a$, $\mathbf{50}_b$, $\mathbf{50}_c$, through which cooling water is circulated, are defined in the cylinder heads 28, 28 and the cylinder block 26 which have the exhaust ports $\mathbf{40}_a$, $\mathbf{40}_b$ and the exhaust passages 47, 47 defined therein, respectively. More specifically, the water jacket $\mathbf{50}_a$ is defined in correspondence to the exhaust port $\mathbf{40}_a$ in the cylinder head 28; the water jacket **50*b* is defined in correspondence to the exhaust port $\mathbf{40}_b$in the cylinder block 26, and the water jacket $\mathbf{50}_c$ is defined in correspondence to the exhaust passage 47 in the cylinder block 26**, and the cooling water flows from the water jacket $\mathbf{50}_c$via the water jacket $\mathbf{50}_b$ into the water jacket $\mathbf{50}_a$.

Temperature sensors 51, 51 for detecting the temperature of walls of the cylinder heads 28, 28 are mounted to the water jacket $\mathbf{50}_a$ covering outer sides of the exhaust ports $\mathbf{40}_a$ corresponding to the upper cylinders 34, 34 in each of the banks $\mathbf{13}_L$ and $\mathbf{13}_R$, respectively. Anode metals 52, 52 are mounted to the water jackets $\mathbf{50}_c$, $\mathbf{50}_c$ in the cylinder block 26, respectively, so that the anode metals are positively corroded to prevent the corrosion of a body of the engine E.

Because the temperature sensors 51, 51 are mounted in the cylinder heads 28, 28, they can be disposed without dependence upon the size and shape of the cylinder block 26. Also, because the temperature sensors 51, 51 are mounted on the outer surfaces of the cylinder heads 28, 28, i.e., on the outer surfaces of the left and right banks $\mathbf{13}_L$ and $\mathbf{13}_R$, the pair of temperature sensors 51, 51 can be disposed so that they do not interfere with each other. Moreover, since the temperature sensors 51, 51 are disposed at locations near the combustion chambers 37, 37, it is possible to improve the accuracy of detection.

The temperature sensors 51, 51 detect the temperature of the engine in an analog manner, but an output therefrom is mathematically processed in the above-described control device 32. If the temperature rises and exceeds a predetermined value, a signal indicative of an overheat of the engine is outputted. This eliminates the need for an overheat switch which has been conventionally required, thereby enabling a reduction in number of parts.

The cylinder head 28 of the right bank $\mathbf{13}_R$ is provided with an oil separating chamber 53 into which a blow-by gas leaked out of the combustion chambers 37 into the crank chamber is introduced. The blow-by gas resulting from the separation of an oil in the oil separating chamber is introduced through a breather passage 54 into the intake silencer 43.

A crank pulley 55 is mounted at an upper end of the crankshaft 12 projecting from an upper surface of the cylinder block 26, and cam pulleys $\mathbf{57}_L$ and $\mathbf{57}_R$ are mounted on a pair of cam shafts 56, 56 projecting on upper surfaces of the pair of cylinder heads 28, 28. The crank pulley 55 and cam pulleys $\mathbf{57}_L$and $\mathbf{57}_R$ are interconnected through an endless belt 59 tensioned by a tension pulley 58.

The structure of the fuel supply system in the engine E will be described below.

A main tank having a large capacity carried in the hull is connected to a connector 62 in a front portion of the engine room 11 through a fuel hose (not shown), and is connected therefrom to a subsidiary tank 68 through a fuel piping $P_1$, a filter 63, a fuel piping $P_2$, a feed pump 64 driven by the left cam shaft 56 and a fuel piping $P_3$. A fuel supplied from the main tank into the subsidiary tank 68 by the feed pump 64 is fed from an injection pump 70 accommodated in the subsidiary tank 68 through a fuel piping $P_4$, a filter 83 and a fuel piping $P_5$ into a fuel passage 84 provided in the right bank $13_R$. And a portion of such fuel is supplied to the two injectors 46, 46 in the right bank 13R. The remainder of the fuel is supplied through a fuel piping $P_6$ into a fuel passage 85 provided in the left bank $13_L$ and into the two injectors 46, 46 in the left bank $13_L$. A surplus fuel is returned through a regulator 88 and a fuel piping $P_7$ to the subsidiary tank 68.

The structure of the intake system in the engine E will be described below.

The intake system is accommodated in the rear space 31 of the engine room 11, and is composed of the intake silencer 43, the elbow 60, the throttle body 44, the surge tank 45 and the intake ports 38. The intake silencer 43 is disposed at a left and lower portion of the rear space 31 of the engine room 11 and fixed to the head cover 29 in the left bank $13_L$ by means such as bolting. The intake silencer 43 has a plurality of air inlets $43_1$ in its rear surface. The elbow 60 connected to a right surface of the intake silencer 43 is curved through 90° to have a horizontal inlet-side axis and a vertical outlet-side axis, and the throttle body 44 is connected to an upper end of the elbow 60. A throttle valve $44_1$ is accommodated within the throttle body 44 and is driven for opening and closing through Bowden wire. An air flow meter 65 and a downstream portion of the throttle valve $44_1$ are connected to each other through a tube 66. The intake silencer 43, the elbow 60 and the throttle body 44 are accommodated in a rear portion of the engine room 11 which projects rearwardly from a rear end of the extension case 1, so that the rear space 31 of the engine room 11 is effectively utilized.

A surge tank 45 having a vertically extending axis is connected at its lower end to an upper end of the throttle body 44, and is provided at an upper portion thereof with an intake gas temperature sensor 67. The surge tank 45 has a pair of left and right flanges $45_1$, $45_1$ fixed to rear faces of the cylinder heads 28 by a plurality of bolts 86. The fuel passages 84 and 85 and the two injectors 46 are fixed to each of the flanges $45_1$ by a plurality of bolts 87. The surge tank 45 and the throttle body 44 connected to the lower portion of the surge tank 45 are accommodated in a space defined between the left and right banks $13_L$ and $13_R$ of the engine E and thus, a waste space between both the banks $13_L$ and $13_R$ is effectively utilized.

The subsidiary tank 68 and the intake silencer 43 are disposed outside the space defined between the left and right banks $13_L$ and $13_R$ of the engine E. More specifically, the subsidiary tank 68 fixed to the throttle body 44 by bolting or the like is disposed on the right side of a longitudinal center line of the engine E, while the intake silencer 43 is disposed on the left side of such center line. Thus, the subsidiary tank 68 and the intake silencer 43 can be disposed with a good balance in the rear space 31 of the engine room 11. Moreover, the large components such as the intake silencer 43, the subsidiary tank 68 and the like are integrally formed with the engine E and therefore, it is possible to easily assemble the engine E to the outboard motor O.

A pair of upper and lower openings $45_2$, $45_2$ formed in a right surface of the surge tank 45 are connected to the intake ports 38, 38 extending to the pair of upper and lower combustion chambers 37, 37 defined in the cylinder head 28 of the right bank $13_R$, respectively. And a pair of upper and lower openings $45_2$, $45_2$ formed in a left surface of the surge tank 45 are connected to the intake ports 38, 38 extending to the pair of upper and lower combustion chambers 37, 37 defined in the cylinder head 28 of the left bank $13_L$, respectively.

Figure 12:
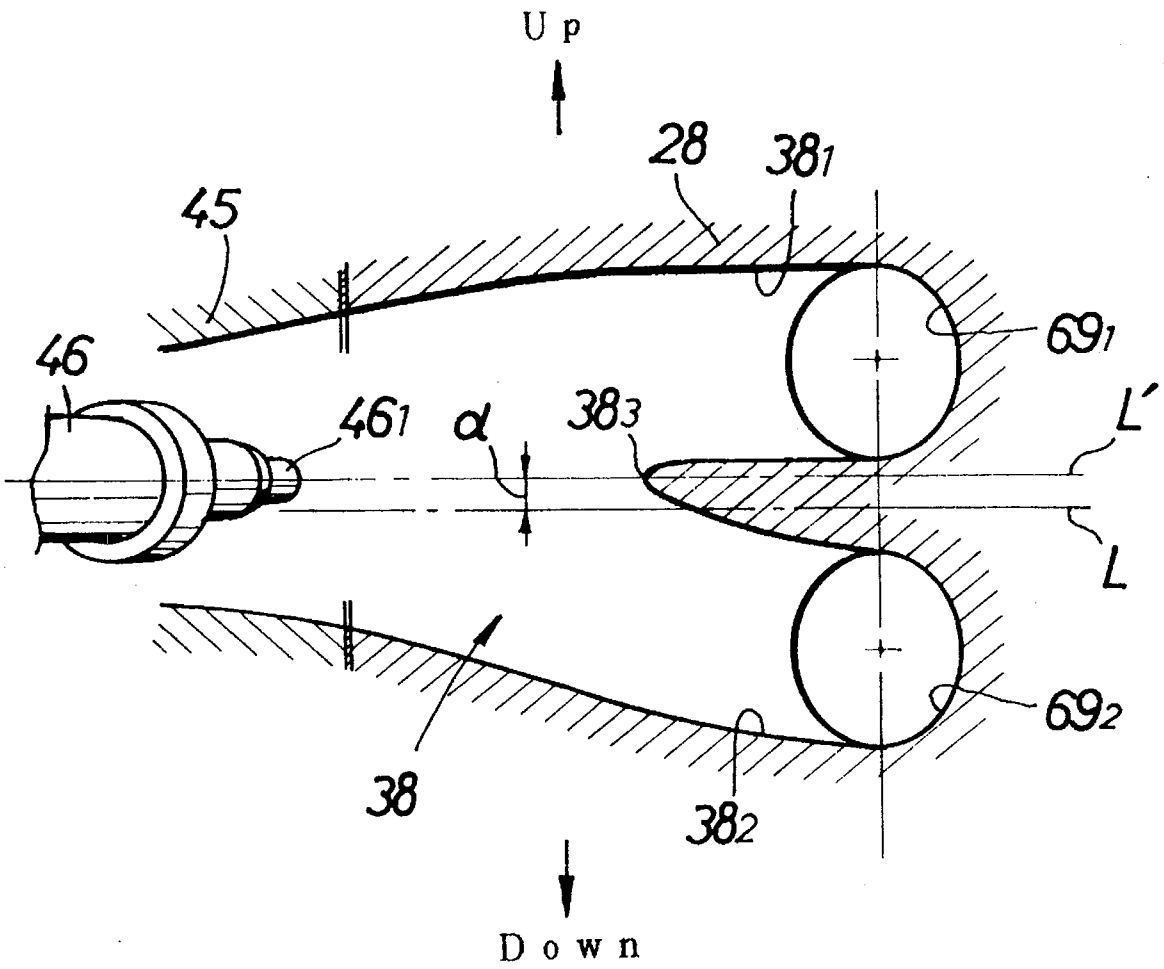

As can be seen from FIG. 12, each intake port 38 is branched into an upper port portion $38_1$ and a lower port portion $38_2$ which are connected to two intake openings $69_1$ and $60_2$ in each combustion chamber 37. A junction $38_3$ between the upper and lower port portions $38_1$ and $38_2$ is displaced upwardly by a distance α from a straight line L extending horizontally through a central portion of a line connecting centers of the pair of intake openings $69_1$ and $69_2$. A nozzle $46_1$ of the injector 46 is disposed on a line L' extending horizontally through the junction $38_3$.

Air drawn through the air inlet $43_1$ in the intake silencer 43 flows from the intake silencer 43 through the elbow 60 into the throttle body 44, and passes through the throttle valve $44_1$ accommodated in the throttle body 44 into the surge tank 45. The air in the surge tank 45 is distributed through the four openings $45_2$ into the four intake ports 38, where the air is mixed with the fuel injected from the injectors 46, and then, the mixed gas is drawn into the combustion chamber 37 through the two intake valves 39, 39 provided in each of the cylinders 34.

Because the intake port 38 is branched into the upper and lower port portions $38_1$ and $38_2$, if the flow rate of the air-fuel mixture within the intake port 38 is reduced during a low speed operation of the engine, the fuel component tends to stay on a bottom wall of the intake port 38, i.e., a bottom wall of the lower port portion $38_2$. If the throttle valve $44_1$ is opened from this condition, it causes a problem that the flow rate of the air-fuel mixture passing through the intake port 38 is rapidly increased and hence, the staying fuel component is drawn quickly into the lower intake opening $69_2$ connected to the lower port portion $38_2$, resulting in an over-rich.

However, since the junction $38_3$ between the upper and lower port portions $38_1$ and $38_2$ is displaced upwardly by the distance α as shown in FIG. 12, the bottom wall of the lower port portion $38_2$ is steeply inclined downwardly toward the lower intake openings $69_2$. This ensures that the fuel component cannot stay on the bottom wall of the lower port portion $38_2$, thereby overcoming the above-described problem with arises when the throttle valve $44_1$ is opened. Moreover, since the nozzle $46_1$ of the injector 46 is disposed at the same level as the junction $38_3$ of the intake port 38, the fuel can be distributed equally into the upper and lower port portions $38_1$ and $38_2$.

The structure of a timing pulse detecting device will now be described in detail.

Figure 2:
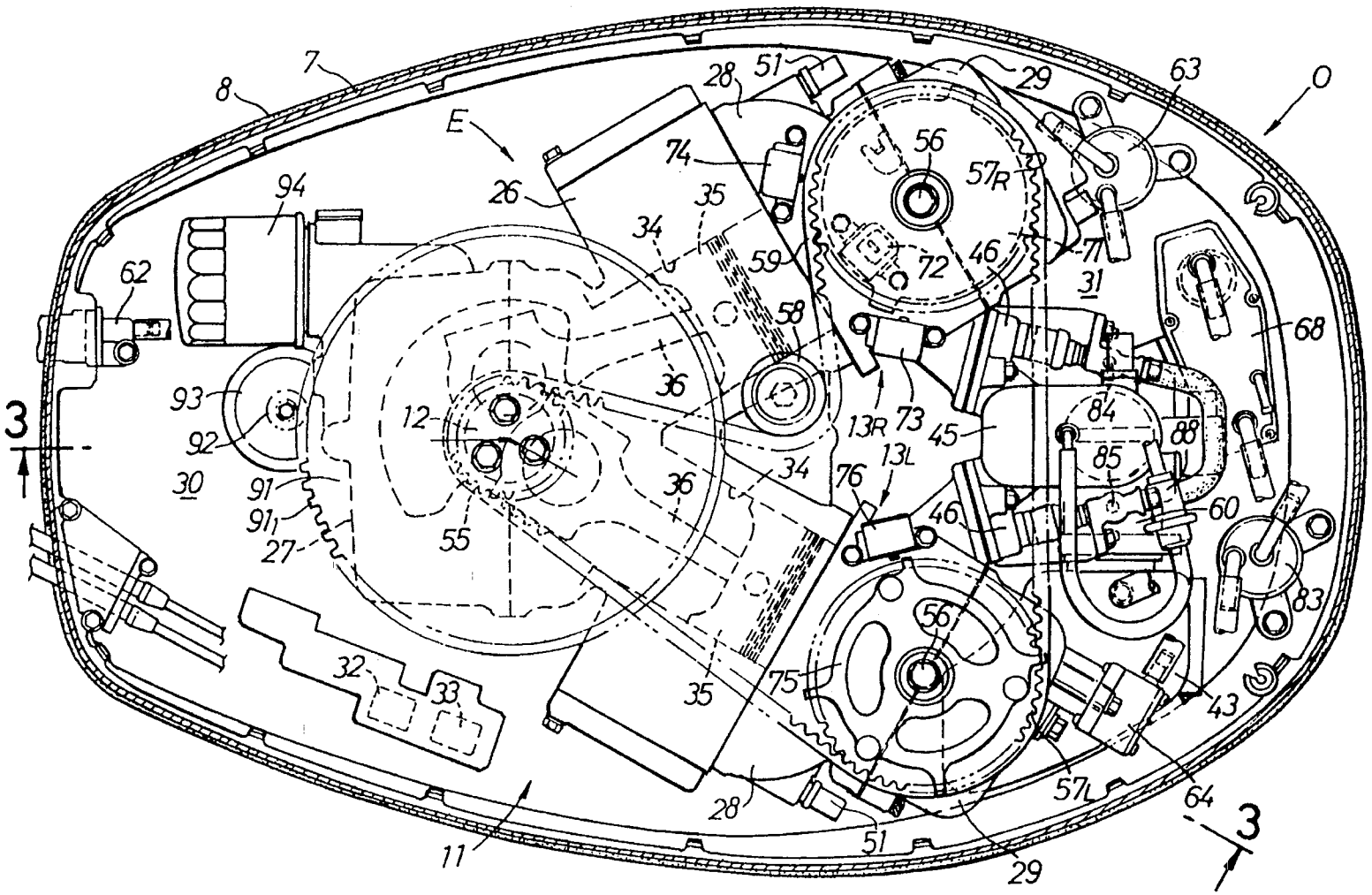
Figure 3:
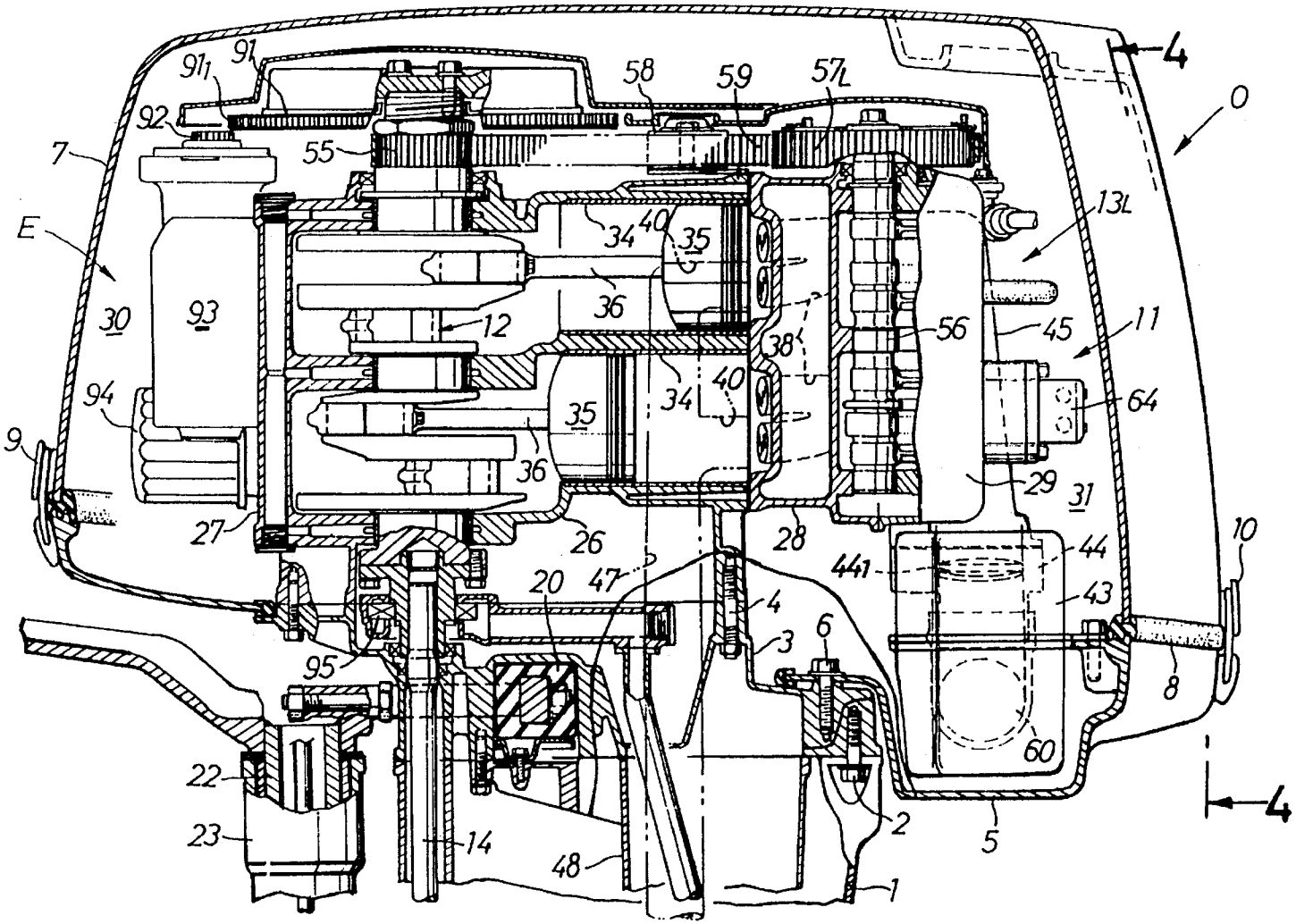

As can be seen from FIG. 2, a driving force of the crank pulley 55 mounted on the crankshaft 12 is transmitted through the endless belt 59 to the cam pulley $57_R$ mounted on the cam shaft 56 in the right bank $13_R$ and the cam pulley $57_L$ mounted on the cam shaft 56 in the left bank $13_L$. A detection magnetic member 71 made of metal plate obtained as a result of a rust-preventing treatment is secured to a lower surface of the right cam pulley $57_R$, and a single cylinder-discriminating coil 72 and two spark-triggering coils 73 and 74 are supported on the upper surface of the cylinder head 28, so that these elements 72 to 74 are opposed to the magnetic detection member 71. A magnetic detection member 75 made of metal plate obtained as a result of a rust-preventing treatment is secured to an upper surface of the left cam pulley $57_L$, and a single top dead center discriminating coil 76 is supported on the upper surface of the cylinder head 28, so that it is opposed to the magnetic detection member 75.

Figure 7:
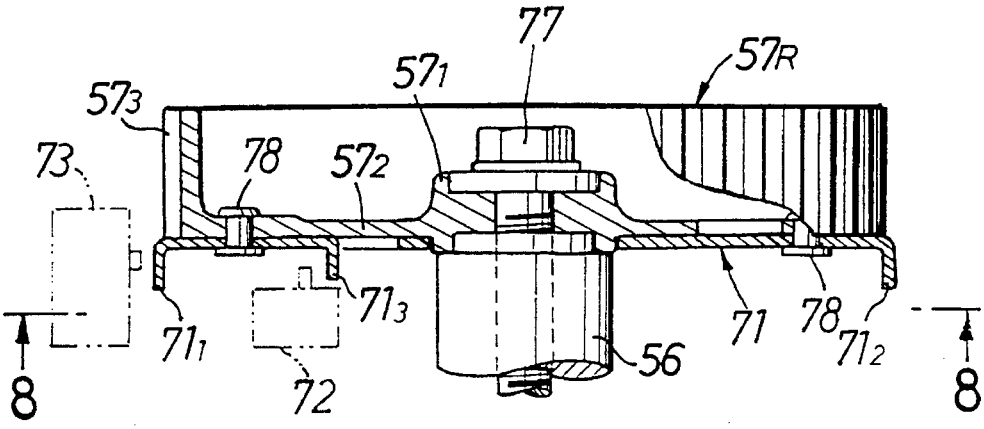
Figure 8:
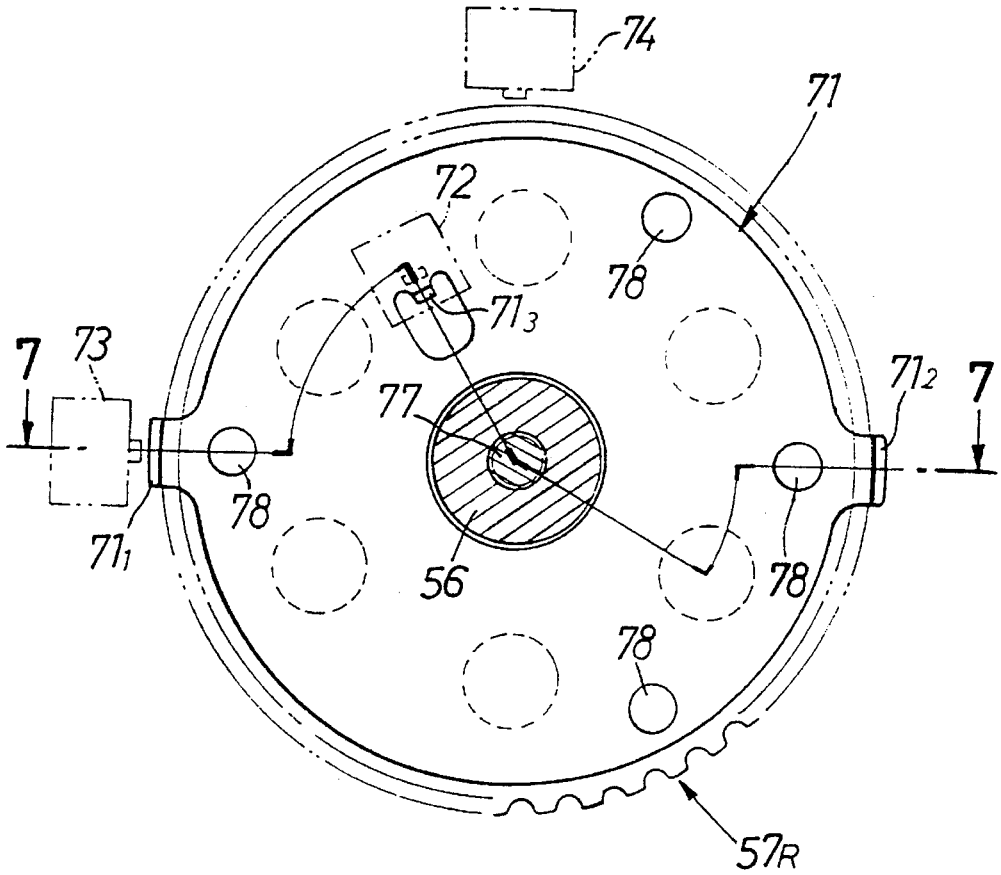

FIGS. 7 and 8 illustrate the right cam pulley $57_R$, which is made of aluminum which is a non-magnetic material. The right cam pulley $57_R$ includes a boss portion $57_1$ fixed to an upper end of the cam shaft 56, a plate-like portion $57_2$ extending radially from the boss portion $57_1$, and a toothed portion $57_3$ formed around an outer periphery of the plate-like portion $57_2$. The cam pulley $57_R$ is provided with the plate-like portion $57_2$ directed downwardly such that the plate-like portion $57_2$ is opposed to the cylinder head 28. The magnetic detection member 71 is secured to a lower surface of the plate-like portion $57_2$ by a plurality of rivets 78.

The magnetic detection member 71 has two detection portion $71_1$ and $71_2$ formed around an outer periphery thereof in a downwardly bent manner at different phases spaced from each other through 180°, and a single detection portion $71_3$ cut and risen downwardly at an inner location than the detection portions $71_1$ and $71_2$ and at a phase different from one of the detection portion $71_1$ through 60°. The two spark-triggering coils 73 and 74 are mounted at different phases spaced apart from each other through 90°, so that they are opposed, from the outside, to the two detection portions $71_1$ and $71_2$ located at radially outer positions. In addition, the cylinder-discriminating coil 72 is mounted, so that it is opposed, from below, to single detection portion $71_3$ located at a radially inner position.

Figure 9:
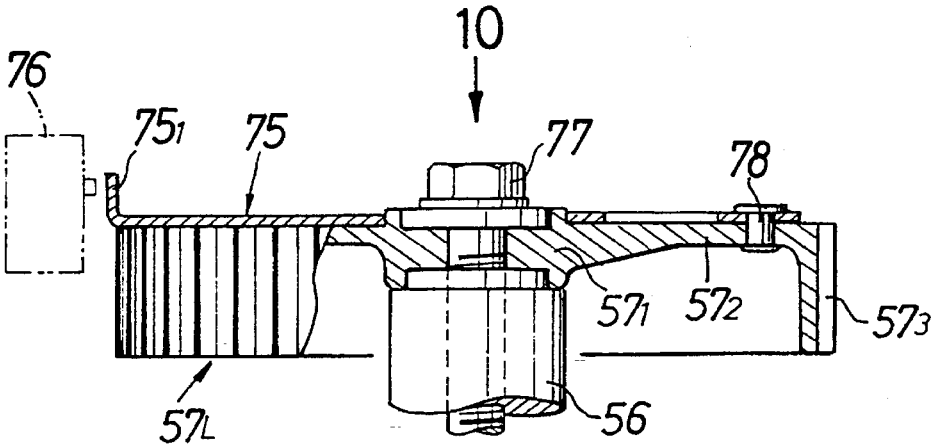
Figure 10:
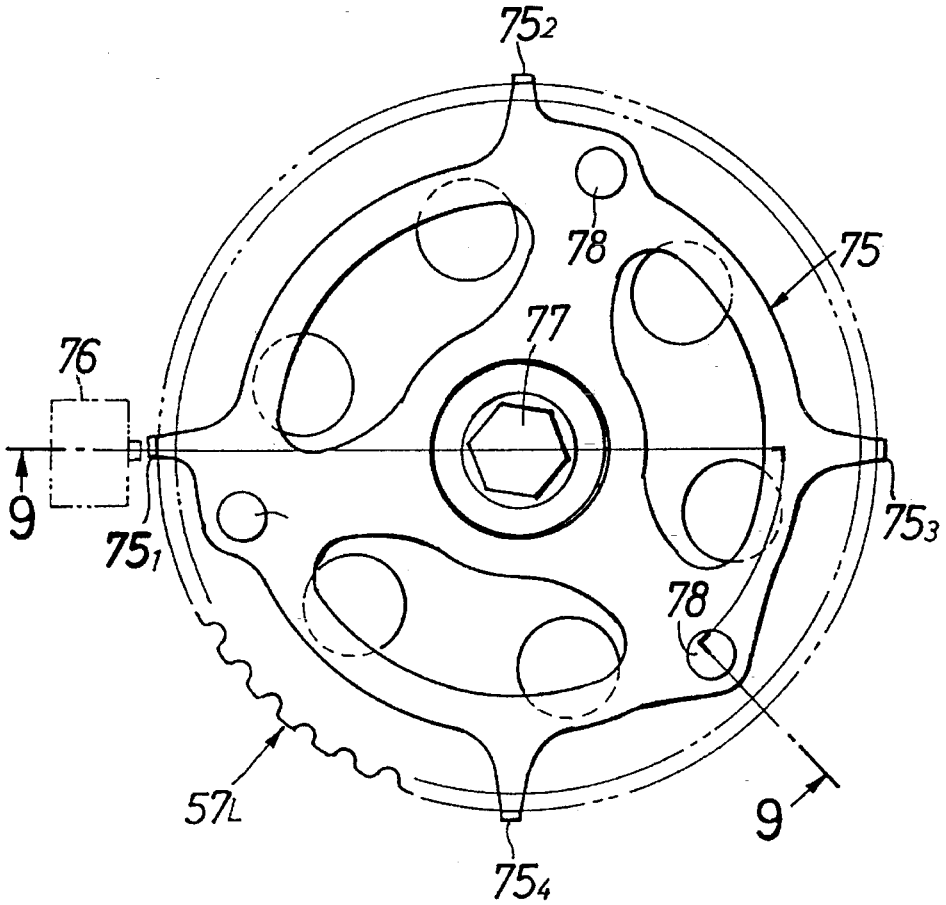

FIGS. 9 and 10 illustrate the left cam pulley $57_L$ which is a member having the same shape as the right cam pulley $57_R$ and includes a boss portion $57_1$, a plate-like portion $57_2$ and a toothed portion $57_3$. However, the left cam pulley $57_L$ is mounted, such that the plate-like portion $57_2$ thereof is directed upwardly, i.e., the left cam pulley $57_L$ is turned inside out from the right cam pulley $57_R$. This ensures that the left and right cam pulleys $57_L$ and $57_R$ can be produced as identical parts, thereby reducing the producing cost. The magnetic detection member 75 is secured to an upper surface of the plate-like portion $57_2$ by a plurality of rivets 78.

The magnetic detection member 75 has four detection portions $75_1$ to $75_4$ formed around an outer periphery thereof at different phases spaced from one another through 90° in an upwardly bent manner. The top dead center discriminating coil 76 is mounted such that it is opposed to these four detection portions $75_1$ to $75_4$ from the outside.

Figure 11:
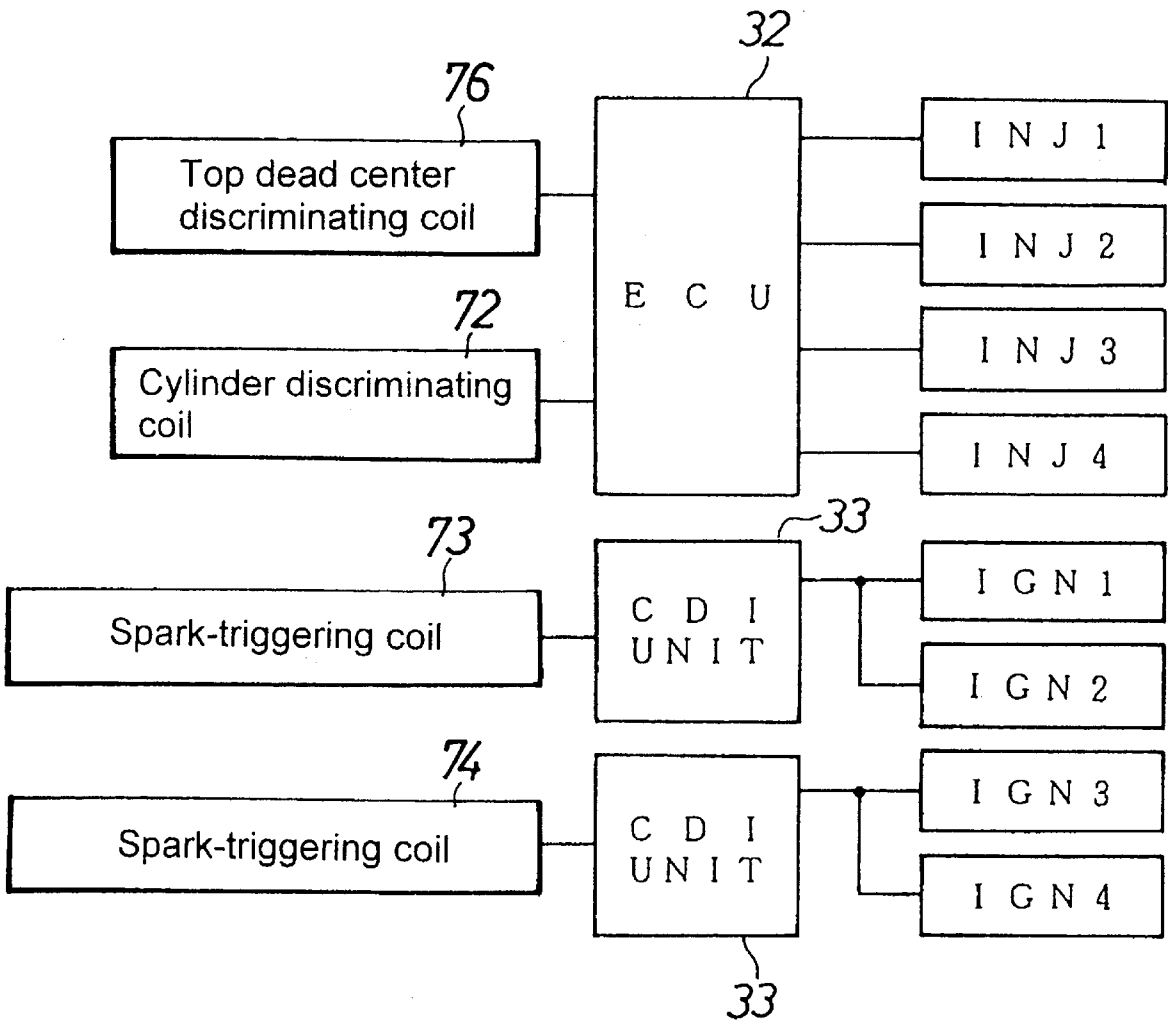

As shown in FIG. 11, a timing pulse from the top dead center discriminating coil 76 and a timing pulse from the cylinder-discriminating coil 72 are inputted, as input signals, into the control device 32 for the electronically controlled type fuel injection system, so that the timing of the injection of the fuel from the four injectors 46 is controlled in response to these timing pulses. Timing pulses from the two spark-triggering coils 73 and 74 are inputted, as input signals, into the control device 33 for the spark plugs, so that the timing of spark of the four spark plugs is controlled in response to these timing pulses.

The operation of the embodiment of the present invention having the above-described construction will be described below.

When the crankshaft 12 is rotated by the operation of the engine E, the pair of cam pulleys $57_L$ and $57_R$ to which the driving force has been transmitted through the crank pulley 55 and the endless belt 59 are rotated at one half the number of revolutions of that of the crankshaft 12. When the magnetic detection member 71 is rotated along with the right cam pulley $57_R$, the two detection portions $71_1$ and $71_2$ formed at the radially outer positions on the magnetic detection member 71 pass through the vicinity of the two spark-triggering coils 73 and 74, thereby to output a timing pulse for the triggering of spark. In addition, if the single detection portion $71_3$ formed at the radially inner position on the magnetic detection member 71 passes through the vicinity of the cylinder discriminating coil 72, a timing pulse for the discrimination of cylinder is also outputted. Likewise, if the magnetic detection member 75 is rotated along with the left cam pulley $57_L$, the four detection portions $75_1$ to $75_4$ formed on the magnetic detection member 75 pass through the vicinity of the top dead center discriminating coil 76, thereby to output a timing pulse for discrimination of top dead center.

Since the detection portions $71_1$ and $71_2$ for triggering of spark and the detection portion $71_3$ for discrimination of cylinder are integrally formed on the magnetic detection member 71 of the right cam pulley $57_R$, and since the spark-triggering coils 73 and 74 and the cylinder-discriminating coil 72 are mounted in correspondence to these detection portions $71_1$, $71_2$ and $71_3$, two kinds of timing pulses can be taken from the one cam pulley $57_R$. At this time, an influence of the coils 72, 73 and 74 on one another is eliminated to prevent a mis-detection, because the spark-triggering detection portions $71_1$ and $71_2$ and the cylinder-discriminating portion $71_3$ are formed in a radially displaced relation, and the two spark-triggering coils 73 and 74 and the single cylinder-discriminating coil 72 are displaced circumferentially. In addition, it is possible to reliably prevent the mis-detection of the cylinder discriminating coil 72, because the magnetic detection member 71 located above the inner cylinder-discriminating coil 72 is circumferentially continuous, excluding the detection portion $71_3$.

Figure 4:
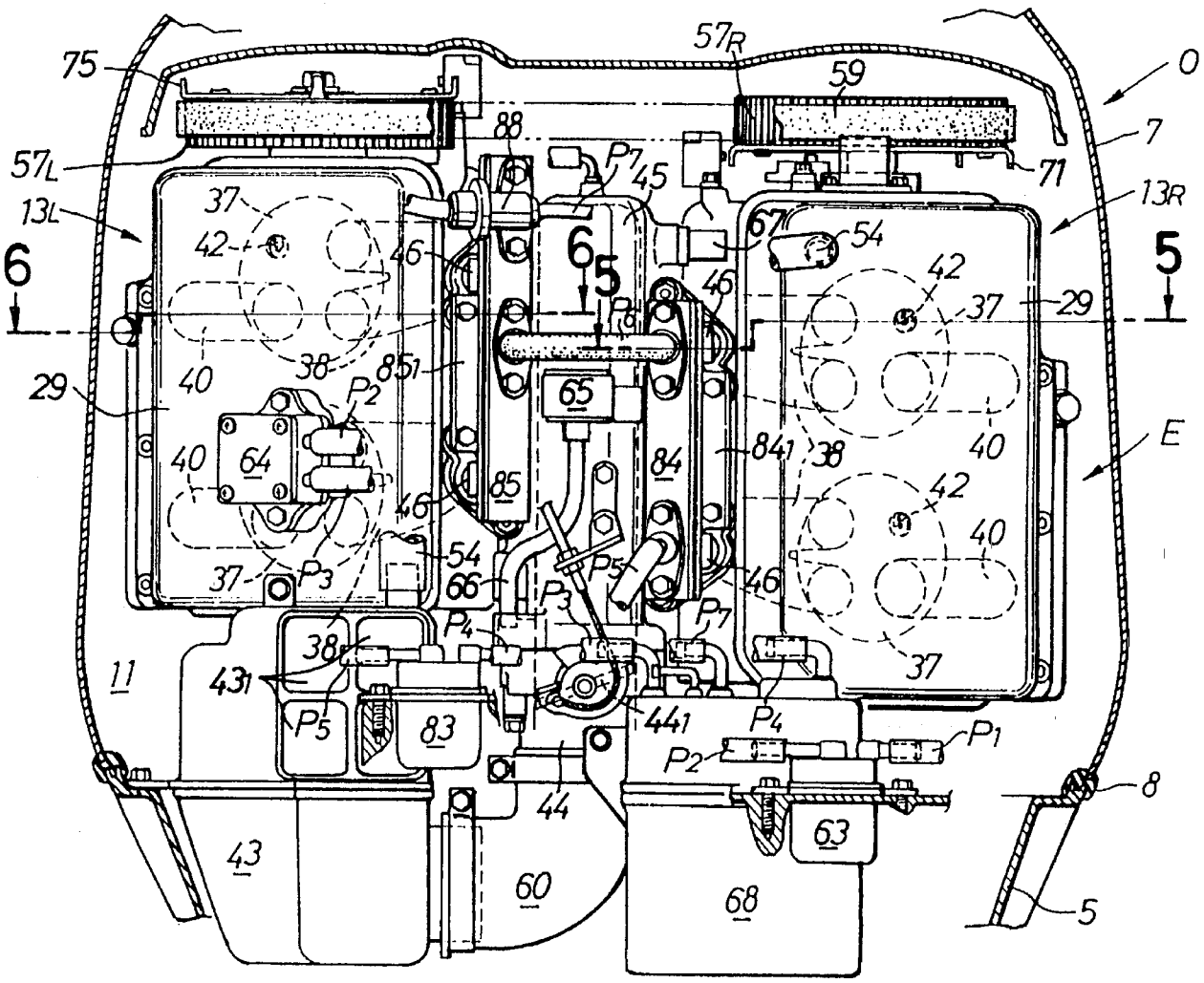

As can be seen from FIG. 4, the upper surface of the right bank $13_R$ of the V-type multi-cylinder engine E is formed at a slightly lower level than the upper surface of the left bank $13_L$, and the cam pulleys $57_L$ and $57_R$ disposed at the upper portions of the banks $13_L$ and $13_R$ are at the same level as each other. Therefore, a gap between the upper surface of the right bank $13_R$ and the lower surface of the cam pulley $57_R$ is larger than a gap between the upper surface of the left bank $13_L$ and the lower surface of the cam pulley $57_L$. Thereupon, by providing the magnetic detection member 71 on the lower surface of the right cam pulley $57_R$ and by providing the detection magnetic member 75 on the upper surface of the left cam pulley $57_L$, the gaps can effectively be utilized to suppress the height of the engine E to a low level.

Figure 13:
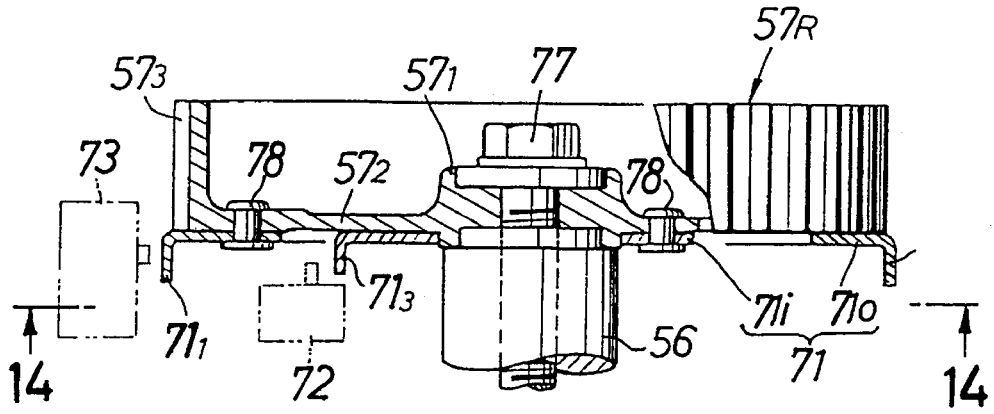
Figure 14:
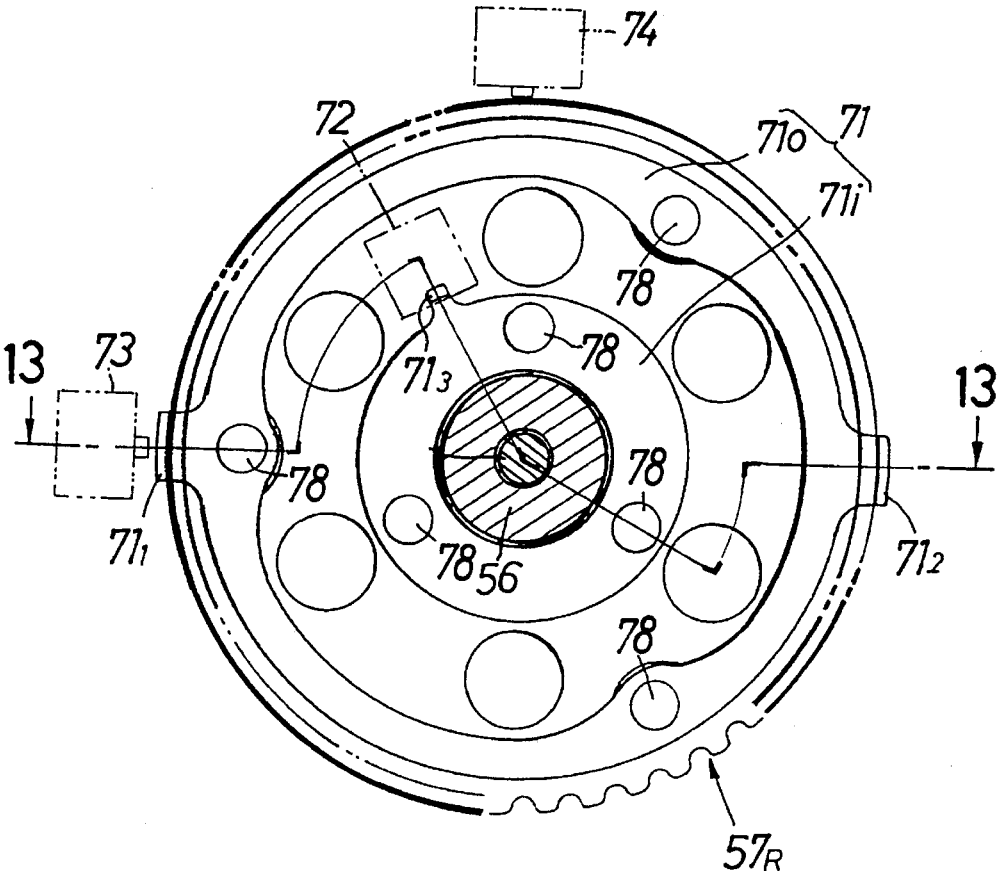

FIGS. 13 and 14 illustrate a second embodiment of a magnetic detection member 71 mounted on the lower surface of the right cam pulley $57_R$.

The magnetic detection member 71 of the second embodiment is divided into two parts, i.e., into an outer magnetic detection member $71_o$ and an inner magnetic detection member $71_i$, both of which are secured to the lower surface of the cam pulley $57_R$ by rivets 78. The outer magnetic detection member $71_o$ is formed with two detection portions $71_1$ and $71_2$, while the inner magnetic detection member $71_i$ is formed with a single detection portion $71_3$.

In this second embodiment, since the magnetic detection member 71 is not located above the inner cylinder-discriminating coil 72, excluding the detection portion $71_3$, it is possible to reliably prevent the mis-detection of such inner cylinder-discriminating coil 72.

What is claimed is:

1. A 4-cycle engine, comprising: a pair of V-shaped banks disposed within an engine room covered with an engine cover such as to open toward an inner face of said engine cover, and an electronically controlled type fuel injection system having an injector, said 4-cycle engine further comprising a sub-tank for temporarily keeping fuel to be supplied to said injector, said injector and said sub-tank being accommodated in a space formed between said pair of banks and said inner face of said engine cover.

* * * * *